United States Patent [19]

Ischi

[11] Patent Number: 4,665,288

[45] Date of Patent: May 12, 1987

[54] COMPRESSED GAS SWITCH

[75] Inventor: Jürg Ischi, Wiler, Switzerland

[73] Assignee: BBC Brown, Boveri & Company, Limited, Baden, Switzerland

[21] Appl. No.: 765,943

[22] Filed: Aug. 15, 1985

[30] Foreign Application Priority Data

Aug. 22, 1984 [CH] Switzerland ..... 4015/84

[51] Int. Cl.[4] ..... H01H 33/18; H01H 33/70

[52] U.S. Cl. ..... 200/147 R; 200/148 B; 200/148 R

[58] Field of Search ..... 200/146 R, 147 R, 148 B, 200/148 R

[56] References Cited

U.S. PATENT DOCUMENTS 2,141,120 12/1938 Whitney et al. ..... 200/146

3,632,932 1/1972 Beaudoin et al. ..... 200/147 R

*Primary Examiner*—Robert S. Macon

*Attorney, Agent, or Firm*—Burns, Doane, Swecker & Mathis

[57] ABSTRACT

A compressed gas switch, preferably provided for switching medium voltages, has a casing filled with insulating gas. Two contacts are located relative to one another along an axis in this casing, which contacts, in the switched-on position, have their free ends led into a hot volume. The switch has a small installation length in the direction of the axis defining the movement of the contacts and simultaneously exhibits small contact consumption. This is achieved by the switch having current supply links led out of the casing transverse to the axis of movement of the contacts, each of which current supply links forming at least one offset in the casing. These offsets are located in a common plane and are designed in such a way that the current to be switched off flows through them in opposite directions.

7 Claims, 3 Drawing Figures

COMPRESSED GAS SWITCH

BACKGROUND OF THE INVENTION

The invention relates to compressed gas switches of the type having two cylindrical contacts within a gas filled casing 1.

A switch of this type is described in the U.S. Pat. No. 4,139,752, in particular FIGS. 1 to 5. In this switch, the arc drawn between the contacts during a switching process is extinguished by means of insulating gas which is heated by the arc and is stored in a hot volume surrounding the contacts. By this means, additional devices for generating an extinguishing gas flow are made unnecessary and the switch drive can be kept small. However, this switch cannot, without further modifications, be installed in any switch position because of its central feed at the fixed contact.

OBJECTS AND SUMMARY OF THE INVENTION

An object of the invention is to provide a gas switch, of the above-mentioned type, which is simply contructed and has a small installation length in the direction of an axis defining the movement of the contacts.

This object is obtained by the use of two electrical supply links penetrating a cylindrical casing transverse to the axis of the cylindrical contacts and each link being offset within the casing. The compressed gas switch according to the invention is characterised in that, because of its small installation length in the direction of the contact axis, it can be installed in switchgear in such a way that the path of the current to be interrupted runs transverse to the contact axis. This makes a particularly space-saving design of switchgear possible. Furthermore, such a switch can be simply fitted because its contact system is manufactured independently of its casing and can be fastened by simply pressing onto a fixed contact located in the casing.

BRIEF DESCRIPTION OF THE DRAWINGS

A preferred embodiment of the invention is illustrated in the drawings, in which.

DETAILED DESCRIPTION

Figure 1:
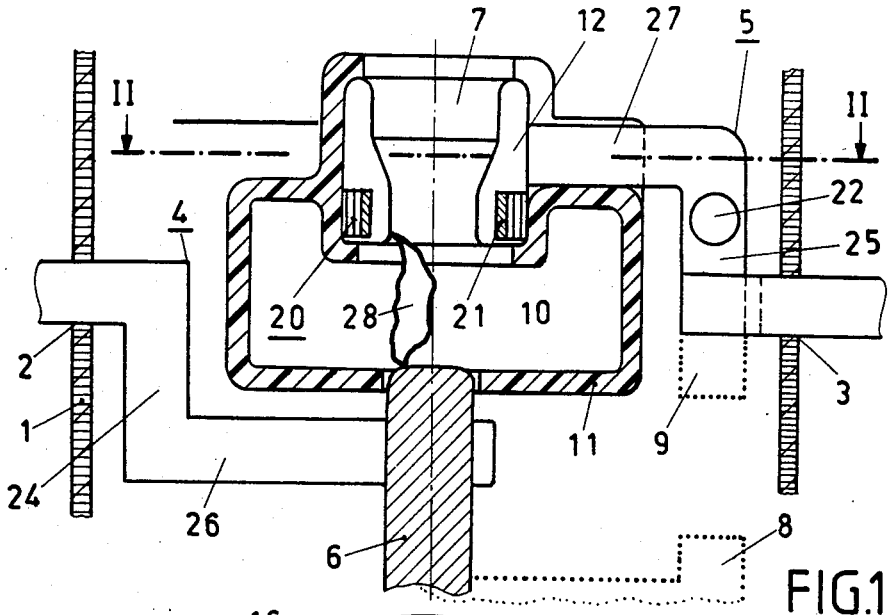
FIG. 1 shows a view on a section, along the line I—I of FIG. 2, through a compressed gas switch designed according to the invention.

In FIG. 1, a cylindrical casing, filled with an insulating gas, such as sulphur hexafluoride at, for example, 4 bar pressure, is indicated by 1. Openings 2 and 3 are provided at mutually diametrically opposite sides of the casing 1, through each of which openings an electricity supply link 4 or 5, respectively, for a movable solid cylindrical contact 6 and a fixed hollow cylindrical contact 7 are led into the interior of the casing 1. The electricity supply link 4 has an electrically conducting connection via a sliding contact (not shown and which may be, for example, a multiple lamination contact) with the contact 6, which is movable in an axial direction along the chain-dotted line by means of a drive, not shown.

The movable contact 6, like the fixed contact 7, is designed to be resistant to burning. Both contacts can be designed for transmitting the nominal current but, when transmitting large nominal currents, it is advantageous to provide the movable contact 6 with a nominal current contact 8, shown dotted in FIG. 1, which nominal current contact 8 interacts with a nominal current contact 9 (also shown dotted) connected to the fixed contact 7 and fastened to the electricity supply link 5. This forms a nominal current path running parallel to the contacts 6 and 7, which now only act as consumable contacts, this parallel nominal current path running outside a hot volume 10, which is surrounded by a body 11, located coaxially with the contacts 6 and 7 and consisting of a pressure and burning resistant insulating material, such as glass-fiber reinforced plastic. The contact 7 does not necessarily have to be designed as a hollow cylinder. It is, rather, also possible for it to be designed as a solid cylinder closing off the hot volume 10. In a corresponding manner, the moving contact 6 can be designed as a hollow cylinder.

The insulating body 11 has a lower opening, in which the movable contact 6 is guided, and an upper opening in which the fixed contact 7 is fastened to the insulating body 11. The fixed contact 7 includes two contact parts 12 and 13 designed as burning resistant nozzle half-shells (FIG. 2), the contacts 12 and 13 being in electrically conducting connection with the electricity supply link 5. This electrically conducting connection can be achieved in that the electricity supply link 5 is led directly to the contact 7 or only acts indirectly on the contact 7.

Figure 2:
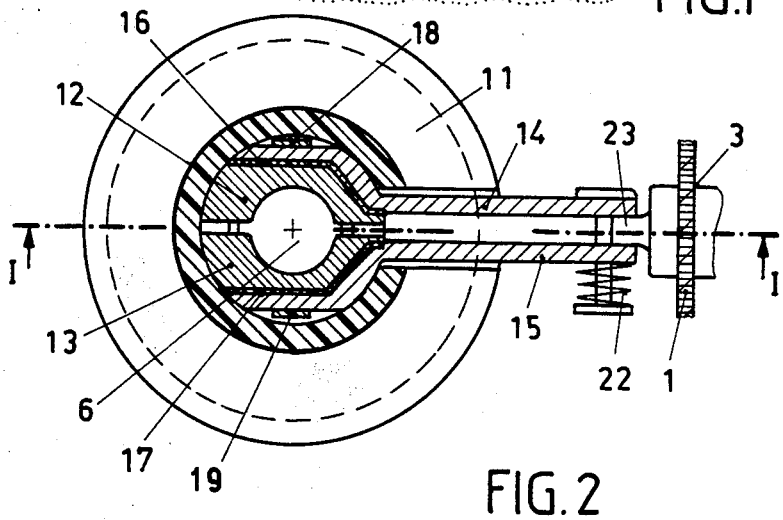
FIG. 2 shows a view on a partial section, along the line II—II of FIG. 1, of the compressed gas switch
Figure 3:
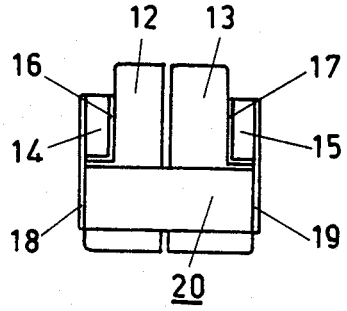
FIG. 3 is a side elevational view of the fixed contact of the compressed gas switch.

As may be seen from FIG. 2, the electricity supply link 5 is formed from two mutually parallel flat bars 14 and 15, which have ends widening out relative to one another in a fork-shape in the region of the contact 7. The ends of the two flat bars 14 and 15 rest on insulation material parts 16 and 17 which are supported on mutually diametrically opposed external surfaces of the two contact parts 12 and 13 (see also FIG. 3). By this means, it is possible to feed the current supply into separate windings 18 and 19 of a coil 20, which coaxially surrounds the contact parts 12, 13 of the contact 7. For this purpose, the ends of the windings 18, 19 remote from the flat bars 14, 15 are connected in an electrically conducting fashion to the spring ring 21 located coaxially with the coil 20, which spring ring 21 presses the contact parts 12, 13 together. The spring ring 21 is made from an electrically conducting material and therefore provides the electrical contact between the coil 20 and the contact parts 12 and 13.

The two flat bars 14, 15 are subject to the action of a spring 22. By this means, the flat bars 14, 15 are, on the one hand, supported in a defined manner on the contact parts 12, 13 and, on the other hand, there is a defined contact force between the flat bars 14, 15 and a fixed contact 23 provided in the electricity supply link. The contact system described above can be completely preassembled and, during the assembly of the compressed gas switch, only needs to be pressed onto the fixed contact 23.

As may be seen from FIG. 1, the electricity supply links 4 and 5 are led out of the casing 1 substantially transverse to the contact axis and each forms at least one offset within the casing. These offsets are located in a plane containing the openings 2 and 3 and the contact axis and each has a section 24 or 25 extending in the axial direction and a section 26 or 27 extending in a direction radial to the contact axis. The section 24 extends from the opening 2 downwards, whereas the section 25 extends from the opening 3 upwards. The section 26 continuing from section 24 extends inwardly of the casing 1 and ends in the sliding contact surrounding the moving contact 6 whereas the sections 27 continuing from the section 25 also extends inwardly into the casing 1 but is designed as flat bars 14, 15 as described above, ending at the contact 7.

This compressed gas switch has the mode of operation described below:

When switching off, the moving contact 6 is moved downwards and, after the opening of the nominal current contacts 8 and 9, possibly provided, an arc 28, caused by the current to be interrupted, is drawn between the subsequently separating contacts 6 and 7. Because of the offsets provided in the electricity supply links 4 and 5, and described above, the electro-magnetic forces acting on the arc 28 are obviated almost completely so that the arc 28, despite the transverse feed, burns substantially centrally so that even consumption of the contacts 6 and 7 is achieved.

In addition, the design of the electricity supply link 5 with parallel flat bars 14 and 15 ensures that the frictional forces can be kept small between the fixed contact 7 and the moving contact introduced into the fixed contact 7 in the switched-on condition. For this purpose, it is only necessary to dimension the distance and the length of the flat bars 14 and 15 in such a way that the attraction forces, caused by the parallel currents in the flat bars at the location of the fixed contact 7, are almost balanced out by the repulsion forces caused by the current transfer from the flat bars to the fixed contact 7.

The consumption of the contacts 6 and 7 is still further reduced because the current to be interrupted flows through the coil 20. The magnetic field caused by the coil 20 does, in fact, cause a rotation of the arc 28 about the axis of the contacts. Since the coil 20 has two windings 18 and 19 each fed in parallel from one flat bar 14 or 15, the attraction force of the flat bars 14 and 15 is maintained even in the region of the fixed contact 7. The spring ring 21 accepting the currents flowing through the parallel windings 18 and 19 of the coil 20 effects the current transfer to the contact parts 12 and 13. The spring forces of this ring should be dimensioned in such a way that in the switched-on condition, i.e. when the moving contact 6 is moved into the contact 7, the action of its force via the contact parts 12 and 13 ensures an adequate current transfer from the fixed contact to the moving contact at both large and small currents. Since, as described, the attraction and repulsion electro-magnetic forces at the contact 7 almost balance at large currents, given suitable dimensioning of the flat bars 14 and 15, it is possible to keep the frictional force between the fixed and moving contacts, and therefore the contact wear, small.

The arc 28 drawn between the contacts 6 and 7 strongly heats the insulating gas in the high current phase so that the gas pressure in the hot volume 10 is greatly increased. As the zero point of the current to be switched off is approached, a powerful flow of the insulation gas stored in the hot volume 10 is initiated through the nozzle opening enclosed by the contact parts 12 and 13 and passes into an expansion space limited by the insulation material body 11 and the casing 1; this extinguishes the arc 28. In this may be seen a further advantageous effect of the invention in that the heated insulation gas arriving in the expansion space impinges initially on the side of the casing 1 opposite to the drive and, by this process, is noticeably cooled during its subsequent flow along the wall of the casing in the part of the casing containing the nominal current contacts 8, 9, if provided. The nominal current contacts 8, 9, if provided, are then—despite the short installation length of the casing in the axial direction—protected in an effective manner from the direct contamination by the extinguishing gases emerging from the hot volume 10 and heated to high temperatures.

Additional magnetic extinguishing is then achieved by means of the coil 20, particularly where it is located in the region of the narrowest part of the opening of the contact 7. Still further blowing can be achieved if the lower opening of the insulation material body 11 is formed as a nozzle opened by the moving contact 6 or if the moving contact 6 is itself designed as a nozzle.

I claim:

1. A compressed gas switch comprising:

a casing adapted to be filled with an insulating gas, an expansion volume enclosed within said casing, a hollow insulating material body arranged within said casing and enclosing a heating volume filled with insulating gas, said body having first and second openings, a stationary cylindrical contact fastened in said first opening, a movable cylindrical contact engageable with said stationary contact within said heating volume when the switch is closed and guidable along a first axis in said second opening when the switch is opened, and a nozzle shaped opening connecting said heating volume to said expansion volume, said nozzle shaped opening being closed by said movable contact when the switch is closed and being released by said movable contact when the switch is opened, first and second current connection links electrically connected to said stationary and movable contacts respectively, each of said links penetrating said casing along a second axis which is substantially transverse to said first axis and having an offset portion within said casing, each of said offset portions including a section extending substantially parallel to said first axis and in an opposite direction from the other offset portion such that magnetic fields generated by current flowing in said offset portions compensate each other and obviate electro-magnetic forces acting on an arc burning in said heating volume between said stationary and movable contacts when the switch is being opened.

2. The compressed gas switch according to claim 1, wherein said stationary contact includes mutually opposite external surfaces and said first current connection link includes at least two flat bars positioned parallel to one another and supported on said external surfaces.

3. The compressed gas switch according to claim 2 further comprising a coil surrounding said stationary contact and being in electrically conducting contact with said stationary contact, said coil having at least two windings, each being connected to one of said flat bars, said flat bars being insulated from said stationary contact.

4. The compressed gas switch according to claim 3, wherein said stationary contact includes two stationary contact parts in the shape of nozzle half-shells which are in said first opening of said insulating material body, the switch further comprising a spring ring in electrically conducting contact with said windings of said coil, said two contact parts being supported on said spring ring.

5. The compressed gas switch according to claim 4, wherein the contacts are each in electrically conducting contact with nominal current contacts, which are attached to the side of the casing remote from the nozzle opening of the nozzle half-shells.

6. The compressed gas switch according to claim 3 further including a spring, said spring acting on said flat bars to urge them against a fixed contact piece in electrical communication with said parts.

7. The compressed gas switch according to claim 6, wherein the flat bars are pressed onto said fixed piece.

* * * * *